US006301805B1

(12) United States Patent
Howlett et al.

(10) Patent No.: US 6,301,805 B1
(45) Date of Patent: Oct. 16, 2001

(54) FULL LENGTH INSOLE FOR OBESE PEOPLE

(75) Inventors: Harold Howlett, Nesbit, MS (US); Bin Xia, Germantown, TN (US); Laura J. Crane, Williston, TN (US); David Foshee, Bartlett, TN (US)

(73) Assignee: Shering-Plough Healthcare Products, Inc., Memphis, TN (US)

( * ) Notice: Subject to any disclaimer, the term of this patent is extended or adjusted under 35 U.S.C. 154(b) by 0 days.

(21) Appl. No.: 09/629,717

(22) Filed: Jul. 31, 2000

(51) Int. Cl.[7] ..... A43B 13/38

(52) U.S. Cl. ..... 36/43; 36/91; 36/92; 36/145; 36/173

(58) Field of Search ..... 36/37, 28, 43, 36/44, 91, 92, 88, 145, 166, 173, 178, 181

(56) References Cited

U.S. PATENT DOCUMENTS

| | | | | |
|---|---|---|---|---|
| 2,255,100 | * | 9/1941 | Brady . | |
| 2,347,207 | * | 4/1944 | Margolin | 36/44 |
| 2,498,624 | * | 2/1950 | Skinner | 36/44 |
| 2,502,774 | * | 4/1950 | Alianiello | 36/44 |
| 2,660,814 | * | 12/1953 | Ritchey . | |
| 4,387,516 | * | 6/1983 | Laux | 36/43 |
| 4,435,910 | * | 3/1984 | Marc | 36/44 |
| 5,517,770 | * | 5/1996 | Martin et al. | 36/43 |
| 5,638,613 | * | 6/1997 | Williams | 36/43 |
| 5,960,566 | * | 10/1999 | Brown | 36/44 |
| 6,038,793 | * | 3/2000 | Kendall | 36/173 |
| 6,131,311 | * | 10/2000 | Brown et al. | 36/43 |
| 6,173,511 | * | 1/2001 | Perrault | 36/92 |

* cited by examiner

*Primary Examiner*—M. D. Patterson
(74) *Attorney, Agent, or Firm*—Robert J. Lipka

(57) ABSTRACT

A removable insole for insertion into footwear, includes a forefoot portion extending at least to metatarsals of a foot, with a second recess at an undersurface thereof with a plurality of cylindrical protuberances in the recess; a cupped heel portion including a relatively flat central portion and a sloped side wall surrounding the relatively flat central portion; a mid-foot portion connecting together the forefoot portion and the heel portion, the mid-foot portion including a medial arch portion defined by an extension of the sloped side wall, the sloped side wall extends to lateral and medial sides of the mid-foot portion, and the forefoot portion, heel portion and mid-foot portion formed from a unitary resilient material; a shell that extends along an underside of the insole, the medial arch portion and the sloped side wall at the heel portion and the mid-foot portion, the shell having an opening beneath the relatively flat central portion of the cupped heel portion and a gap at a rearmost end of the shell so as to define flanges on opposite sides of the insole at the heel portion, the unitary resilient material extending out through the opening in the shell, and includes a recess at an undersurface thereat with a plurality of cylindrical protuberances in the recess, and the shell being made of a flexible material that is stiffer than the unitary resilient material; and a top cover secured to upper surfaces of the forefoot portion, mid-foot portion and heel portion.

15 Claims, 4 Drawing Sheets

FULL LENGTH INSOLE FOR OBESE PEOPLE

BACKGROUND OF THE INVENTION

The present invention relates generally to shoe insoles, and more particularly, to improved insoles particularly adapted for obese people.

According to an article "Demography, Obesity: A Growing Problem, " The Futurist, October, 1999, approximately 22% of adults in the United States are obese, with obesity defined by the World Health Organization as a body mass index greater than or equal to 30 $Kg/m^2$.

The inventors herein designed and executed an investigative gait and foot morphology study to define the gait biomechanics and foot morphology of obese men and women. It was discovered that obese people exerted more load under the arch and lateral side of their feet during gait in comparison with individuals having a body mass index less than or equal to 25 $kg/m^2$. Approximately 36% of the obese women subjects provided varying degrees of pes planus (flat feet), while approximately 43% of the obese men subjects provided varying degrees of pes planus (flat feet). Further, the frequency of moderate fatigue or discomfort in the foot, leg and lower back exceeded 50% in the male and female population. Still further, overall gait speed tended to be slower than that for that part of the population having a normal weight, that is, a body mass index less than or equal to 25 $kg/m^2$.

From this study, it was determined that:

a) obese people have wider feet and put more pressure on the mid-foot and forefoot portions;

b) obese people overpronate, tending to flatten or fall on the inside arch of the foot;

c) obese people have a tendency to walk with their feet wider apart, and this, in combination with the overpronation (flat feet), prevents normal foot motion during walking; and d) obese people tend to roll their feet outward during heel strike, thereby introducing an extraneous motion to the foot, in contrast to normal weight people who do not roll their feet during heel strike. This increases the loading in the lateral arch region during gait.

SUMMARY OF THE INVENTION

Accordingly, it is an object of the present invention to provide an insole that overcomes the aforementioned problems.

It is another object of the present invention to provide an insole for obese people.

It is still another object of the present invention to provide an insole which reduces lower extremity, back and foot pain for obese people.

It is yet another object of the present invention to provide an insole which cushions the total foot contact area from heel strike through mid-foot stance, and during toe off (propulsion) for obese people.

It is a further object of the present invention to provide an insole which provides additional flexibility and cushioning for obese people.

It is a still further object of the present invention to provide an insole which provides control and substantial reduction of overpronation for obese people.

It is a yet further object of the present invention to provide an insole that provides a comprehensive arch and mid-foot support for obese people.

It is another object of the present invention to provide an insole that provides lateral foot support for obese people.

It is still another object of the present invention to provide an insole that will accommodate multiple heel sizes for obese people.

It is yet another object of the present invention to provide an insole that positions the fat pad under the calcaneus for obese people.

It is a further object of the present invention to provide an insole that is easy and economical to make and use.

In accordance with an aspect of the present invention, a removable insole for insertion into footwear, includes a forefoot portion extending at least to metatarsals of a foot; a cupped heel portion including a relatively flat central portion and a sloped side wall surrounding the relatively flat central portion; a mid-foot portion connecting together the forefoot portion and the heel portion, the mid-foot portion including a medial arch portion defined by an extension of the sloped side wall, and the forefoot portion, heel portion and mid-foot portion formed from a unitary resilient material; and a shell that extends along an underside of the insole, the shell extending under the medial arch portion and the side wall, the shell having an opening beneath the relatively flat central portion of the cupped heel portion and a gap at a rearmost end of the shell so as to define flanges on opposite sides of the insole at the heel portion, and the shell being made of a flexible material that is stiffer than the unitary resilient material.

The sloped side wall extends to lateral and medial sides of the mid-foot portion, and the shell extends along an underside of the sloped side wall at the heel portion and the mid-foot portion.

The unitary resilient material extends out through the opening in the shell, and includes a recess at an undersurface thereat with a plurality of first protuberances in the recess, the first protuberances forming spaced apart spring walls and the first protuberances having lower edges generally coplanar with a lower surface of the heel portion. Preferably, the first protuberances have a generally cylindrical configuration. Also, the unitary resilient material includes a second recess at an undersurface thereof at the forefoot portion, with a plurality of second protuberances in the second recess, the second protuberances forming spaced apart spring walls and the second protuberances having lower edges generally coplanar with a lower surface of the heel portion. Preferably, the second protuberances have a generally cylindrical configuration. The first and second protuberances have a height and width, and the height of the second protuberances is less than the height of the first protuberances, and the width of the second protuberances is greater than the width of the first protuberances.

A top cover is secured to upper surfaces of the forefoot portion, mid-foot portion and heel portion.

Also, at least one pattern trim line is formed at the forefoot portion for trimming the insole to fit into smaller size footwear.

Lastly, the medial arch portion has a height greater than a remainder of the mid-foot portion, and extends approximately 40% of the distance from a medial side of the insole to a lateral side of the insole.

In accordance with another aspect of the present invention, footwear includes an outer sole; an inner sole connected to the outer sole, the inner sole including a forefoot portion extending at least to metatarsals of a foot, a cupped heel portion including a relatively flat central portion and a sloped side wall surrounding the relatively flat central portion, a mid-foot portion connecting together the forefoot portion and the heel portion, the mid-foot portion including a medial arch portion defined by an extension of the sloped side wall, and the forefoot portion, heel portion and mid-foot portion formed from a unitary resilient material, and a shell that extends along an underside of the insole, the shell extending under the medial arch portion and the side wall, the shell having an opening beneath the relatively flat central portion of the cupped heel portion and a gap at a rearmost end of the shell so as to define flanges on opposite sides of the insole at the heel portion, and the shell being made of a flexible material that is stiffer than the unitary resilient material; and an upper connected to at least one of the outer sole and the inner sole.

The above and other features of the invention will become readily apparent from the following detailed description thereof which is to be read in connection with the accompanying drawings.

DETAILED DESCRIPTION

Figure 1:
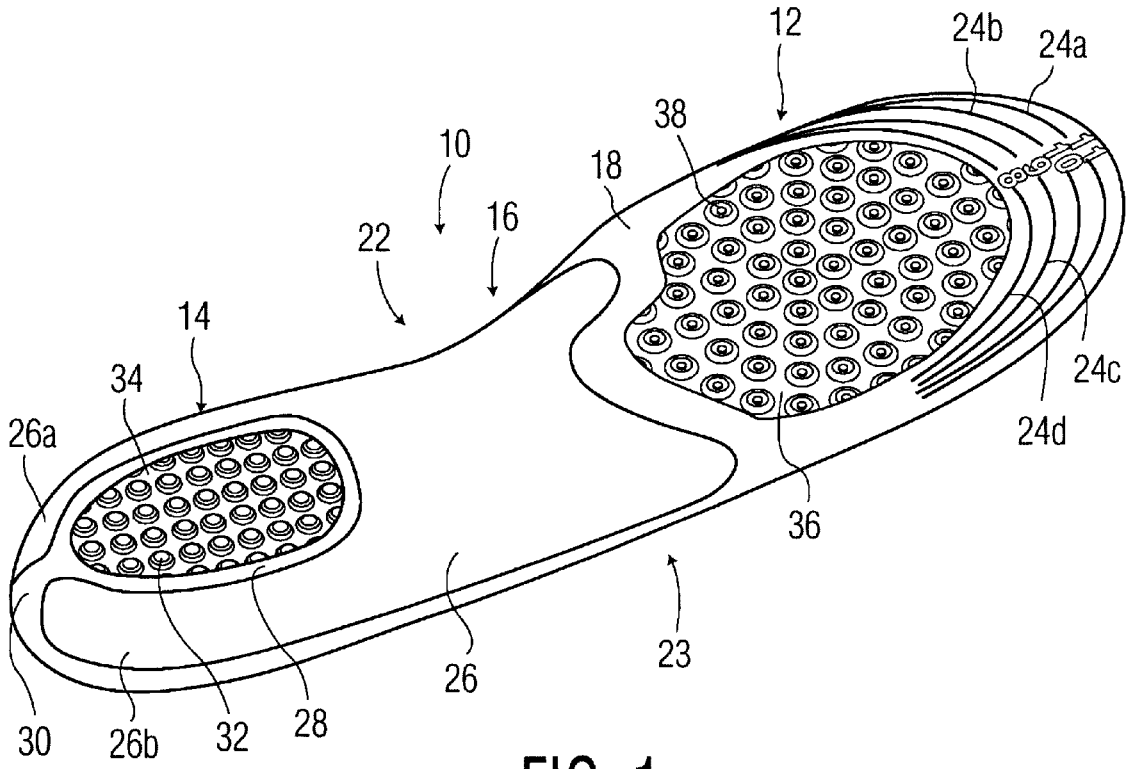
FIG. 1 is a bottom perspective view of a left insole according to the present invention.

Referring to the drawings in detail, a left insole 10 according to a first embodiment of the present invention is adapted to be placed in an article of footwear, as is well known. A right insole (not shown) is identical to left insole 10 and is a mirror image thereof. Insole 10 is particularly adapted to alleviate back, hip, leg and foot pain in obese people.

Insole 10 has the shape of a human left foot and therefore includes a curved toe or forefoot portion 12, a heel portion 14, and a mid-foot portion 16 which connects forefoot portion 12 and heel portion 14 together. Heel portion 14 has a greater thickness than forefoot portion 12. For example, heel portion 14 may have a thickness in the range of about 0.16 inch to 0.25 inch for men's insoles and in the range of about 0.16 inch to 0.24 inch for women's insoles, while forefoot portion 12 may have a thickness in the range of about 0.12 inch to 0.22 inch for men's insoles and in the range of about 0.12 inch to 0.20 inch for women's insoles.

Insole 10 is formed by a lower cushioning layer 18 and a top cover 20 secured to the upper surface of cushioning layer 18, along forefoot portion 12, cupped heel portion 14 and mid-foot portion 16, by any suitable means, such as adhesive, RF welding, etc.

Cushioning layer 18 can be made from any suitable material including, but not limited to, any flexible material which can cushion and absorb the shock from heel strike on the insole. Suitable shock absorbing materials can include any suitable foam, such as but not limited to, cross-linked polyethylene, poly(ethylene-vinyl acetate), polyvinyl chloride, synthetic and natural latex rubbers, neoprene, block polymer elastomer of the acrylonitrile-butadiene-styrene or styrene-butadienestyrene type, thermoplastic elastomers, ethylenepropylene rubbers, silicone elastomers, polystyrene, polyurea or polyurethane; most preferably a polyurethane foam made from flexible polyol chain and an isocyanate such as a monomeric or prepolymerized diisocyanate based on 4,4'-diphenylmethane diisocyanate (MDI) or toluene diisocyanate (TDI). Such foams can be blown with freon, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50 degrees C. to 100 degrees C. may also be advantageously employed. A resilient polyurethane can be prepared from diisocyanate prepolymer, polyol, catalyst and stabilizers which provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J.; Pluracol 945 (CAS 9082-00-2) and Pluracol 1003, both available from BASF, Parsippany, N.J.; Multrinol 9200, available from Mobay, Pittsburgh, Pa.; MDI diisocyanate prepolymer XAS 10971.02 and polyol blend XUS 18021.00 available from the Dow Chemical Company, Midland, Mich.; and Niax 34–28, available from Union Carbide, Danbury, Conn. These urethane systems generally contain a surfactant, a blowing agent, and an ultra-violet stabilizer and/or catalyst package. Suitable catalysts include Dabco 33-LV (CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa.; Fomrez UL-38, a stannous octoate, from the Witco Chemical Co., New York, N.Y. or A-1(CAS 3033-62-3) available from OSI Corp., Norcross, Ga. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C., or Givsorb UV-1 (CAS 057834-33-0) and Givsorb UV-2 (CAS 065816-20-8) from Givaudan Corporation, Clifton, N.J. Suitable surfactants include DC-5169 (a mixture), DC190 (CAS68037-64-9), DC197 (CAS69430-39-3), DC-5125 (CAS 68037-62-7) all available from Air Products Corp., Allentown Pa. and L-5302 (CAS trade secret) from Union Carbide, Danbury Conn. Alternatively, lower layer 18 can be a laminate construction, that is, a multilayered composite of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers). Preferably, cushioning layer 18 is made from a urethane molded material.

The materials of lower layer 18 can be prepared by conventional methods such as heat sealing, ultrasonic sealing, radio-frequency sealing, lamination, thermoforming, reaction injection molding, and compression molding and, if necessary, followed by secondary die-cutting or in-mold die cutting. Representative methods are taught, for example, in U.S. Pat. Nos. 3,489,594; 3,530,489 4,257,176; 4,185,402; 4,586,273, in the Handbook of Plastics, Herber R. Simonds and Carleton Ellis, 1943, New York, N.Y., Reaction Injection Molding Machinery and Processes, F. Melvin Sweeney, 1987, New York, N.Y., and Flexible Polyurethane Foams, George Woods, 1982, New Jersey, whose preparative teachings are incorporated herein by reference. For example, the innersole can be prepared by a foam reaction molding process such as taught in U.S. Pat. No. 4,694,589.

Top cover 20 can be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral top covers. Desirable characteristics of top cover 20 include good durability, stability and visual appearance. It is also desirable that top cover 20 have good flexibility, as indicated by a low modulus, in order to be easily moldable. The bonding surface of top cover 20 should provide an appropriate texture in order to achieve a suitable mechanical bond to the upper surface of lower layer 18. Preferably, the material of top cover 20 is a fabric, such as a brushed knit laminate top cloth (brushed knit fabric/urethane film/non-woven scrim cloth laminate) or a urethane knit laminate top cloth. Preferably, top cover 20 is made from a polyester fabric material, and preferably has a thickness of about 0.02 inch.

During use, insole 10 is placed in a shoe so that the medial side 22 containing a raised medial arch portion 16*a* of mid-foot portion 16 rests against the inside of the shoe. Forefoot portion 12 may end just in front of the metatarsals. Insole 10 is a full length insole, that is, extends along the entire foot.

Typically, insole 10 would be sized corresponding to shoe sizes and would be provided in sized pairs. Alternatively, insole 10 may be trimmed to the requirements of the user. In this regard, arcuate pattern trim lines 24*a*–24*d* may be formed on the lower surface of forefoot portion 12 of insole 10, as shown in FIG. 1, and which are representative of various sizes of the human foot. For example, insole 10 may be provided for a man's shoe size of 12, with first continuous pattern trim line 24*a* being representative of a smaller size insole for a man's shoe size 11, second continuous pattern trim line 24*b* extending around the periphery of forefoot portion 12 indicative of another size of insole for a man's shoe size 10, third continuous pattern trim line 24*c* extending around the periphery of forefoot portion 12 indicative of another size of insole for a man's shoe size 9, and fourth continuous pattern trim line 24*d* extending around the periphery of forefoot portion 12 indicative of another size of insole for a man's shoe size 8. If the user requires a size other than the original large size, the wearer merely trims the insole with a scissors or cutting instrument, using pattern trim lines 24*a*–24*d*, to achieve the proper size. The pattern trim lines may be imprinted by conventional printing techniques, silkscreening and the like. As an alternative, pattern trim lines 24*a*–24*d* may be formed as shallow grooves, or be perforated, so that a smaller size insole may be separated by tearing along the appropriate trim lines, which tearing operation is facilitated by the inclusion of perforations. Thus, forefoot portion 12 can be trimmed so that forefoot portion 12 fits within the toe portion of a shoe.

A cup-shaped arrangement is also provided for the heel and mid-foot in order to stabilize the mid-foot and heel, while at the same time, providing overall cushioning and shock absorption of the mid-foot and heel. This is because there are joints in the mid-foot area and heel. If the foot is not stabilized, that is, without undue side to side movement, there may be pain due to the excessive joint forces.

Specifically, as shown, heel portion 14 includes a relatively flat central portion 14*a*, and a sloped side wall 14*b*. Generally, when a heel strikes a surface, the fat pad portion of the heel spreads out. The cupped heel portion thereby stabilizes the heel of the person and maintains the heel in heel portion 14, to prevent such spreading out of the fat pad portion of the heel, and to also prevent any side to side movement of the heel in heel portion 14.

The side wall 14*b* of heel portion 14 extends forwardly to the mid-foot as a flange or side wall 16*b* on the lateral and medial sides of mid-foot portion 16, with side wall 16*b* extending to a further extent forwardly at the medial side 22 to correspond to the medial arch portion 16*a* thereat. According to the present invention, raised arch portion 16*a* extends from the medial side 22 toward the lateral side 23 of insole 10 by a greater amount than conventional insoles, for example, 40% toward lateral side 23. This results in a counteraction to the overpronation that normally occurs in obese people, that is, this increased arch support functions to prevent overpronation. It will also be appreciated that side wall 16*b* thereby starts at heel portion 14 and extends at least to a midpoint of insole 10, to provide a foot cradle.

In accordance with the present invention, insole 10 is made wider than normal insoles, for example, an extra 0.25 inch wider to accommodate the wider feet of obese people. Further, forefoot portion 12 is provided with a thickness greater than conventional insoles in order to accommodate the greater pressure thereon.

More importantly, a thin shell 26 of about 0.04 inch (1 mm) thickness is provided on the underside of insole 10. Shell 26 is made of a more rigid or stiffer material than lower cushioning layer 18 and provides extra support. Thus, while lower cushioning layer 18 is made from a resilient and deformable foam material, shell 26 is made from a flexible, stiffer thermoplastic polymer, elastic polymer, flexible thermoplastic material or the like, but is substantially not resilient. Shell 26 can be made of any flexible material including but not limited to injection molded thermoplastic elastomers such as thermoplastic urethane, thermoplastic polyethylene or other injection molded polymers, and polymers that can be thermoformed such as ethylene vinyl acetate (EVA) or nylons.

Shell 26 aids in defining a more substantial raised arch portion 16*a* so as to counter the overpronation that occurs with obese people. In this regard, shell 26 extends up side walls 14*b* and 16*b* to provide extra support. Further, shell 26 further supports raised arch portion 16*a* which extends to a further extent toward lateral side 23 of insole 10 by a greater amount than conventional insoles. Also, shell 26 further supports the heel cradle which provides extra support, that is, by extending up side wall 14*b* of heel portion 14.

Figure 2:
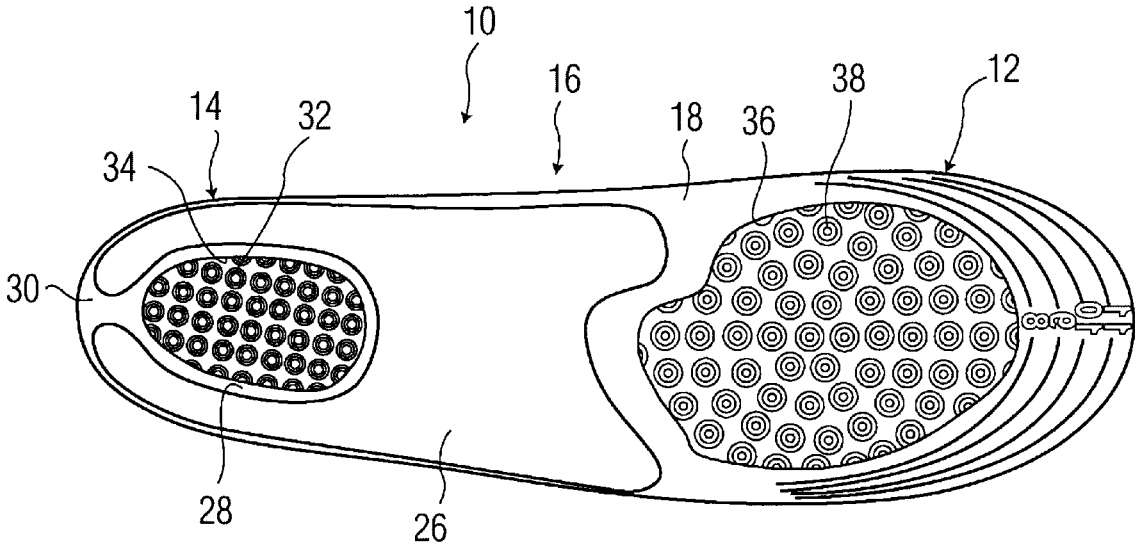
FIG. 2 is a bottom plan view of the left insole.
Figure 3:
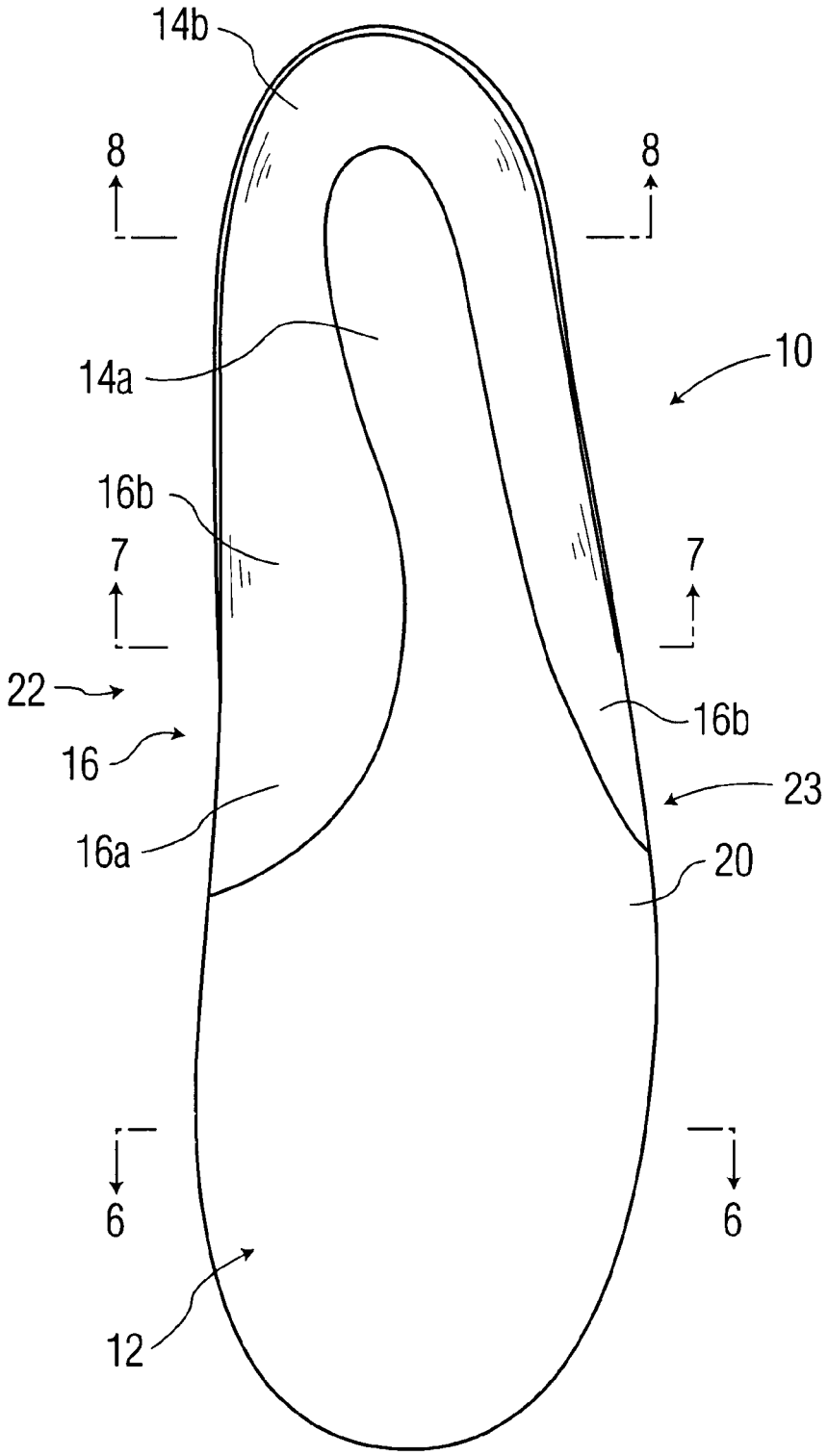
FIG. 3 is a top plan view of the left insole.
Figure 4:
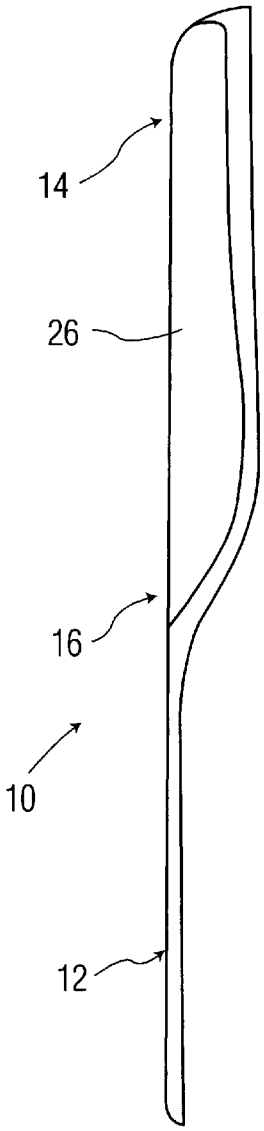
FIG. 4 is a side elevational view of the left insole.
Figure 5:
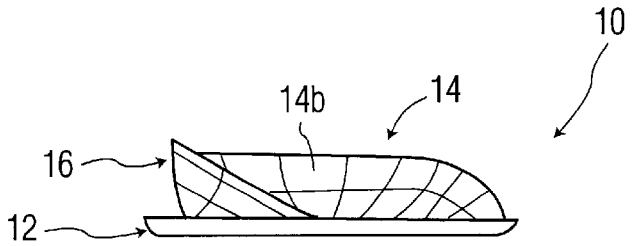
FIG. 5 is a front elevational view of the left insole.
Figure 6:
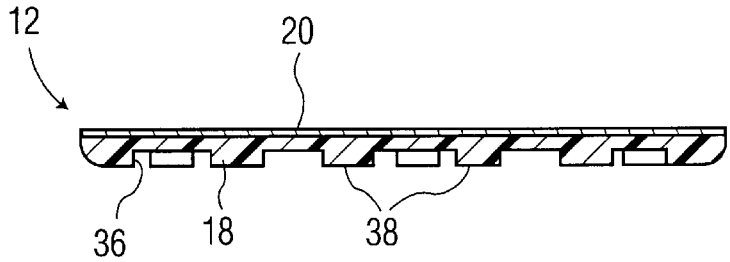
FIG. 6 is a cross-sectional view of the left insole, of substantially actual size, taken along line 6—6 of FIG. 3.
Figure 7:
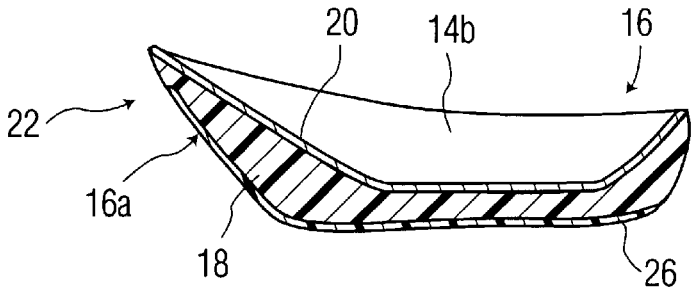
FIG. 7 is a cross-sectional view of the left insole, of substantially actual size, taken along line 7—7 of FIG. 3.
Figure 8:
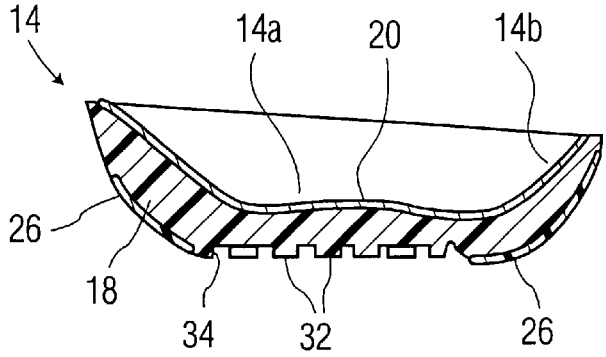
FIG. 8 is a cross-sectional view of the left insole, of substantially actual size, taken along line 8—8 of FIG. 3.

However, shell 26 does not extend along the entire heel portion 14. Specifically, as shown best in FIGS. 1, 2 and 8, shell 26 includes a substantially oval opening 28 at the center of heel portion 14 corresponding to the fat pad of the person striking heel portion 14 during a normal gait, and there is a gap 30 at the rear end of heel portion 14 in open communication with opening 28. As a result, shell 26 forms two rear heel flanges 26*a* and 26*b* on opposite sides of opening 28. Because of this construction, expansion of heel portion 14 is permitted when an obese person steps onto insole 10. Specifically, this permits expansion of heel portion 14 to accommodate different size heels. This is because the heel of an obese person is wider than conventional heels, and tends to flatten out. By providing flanges 26*a* and 26*b*, the heel of the person is still supported in a cup-like manner, but a slight expansion of heel portion 14 is still permitted.

As discussed above, obese person, when walking, tend to roll outward during the heel strike, thereby providing an extraneous motion to the heel strike, in contrast to normal weight people who start rolling outward at the midpoint of the foot, that is, at a much later stage. This outward roll continues from the heel through the entire motion of the foot. Shell 26 functions to deter such roll out during the heel strike, thereby forcing the person to roll forward rather than sidewards. This is due to the stiffer material of shell 26 used therewith.

Another reason for providing oval opening 28 is to provide equally spaced apart small protuberances 32 in an oval recess 34 on the underside of heel portion 14.

Preferably, protuberances 32 have a cylindrical configuration of approximately 0.16 inch diameter and a height of about 0.06 inch, although the present invention is not limited thereby. For example, protuberances 32 can have other dimensions and other configurations such as square, triangular or polygonal cross-sectional columnar shapes, or other shapes, such as spaced apart sinusoidal walls or the like. The lower ends of protuberances 32 are substantially coplanar with the lower surface of insole 10. Protuberances 32 effectively form spaced apart, elastic, resilient spring walls.

In like manner, a recess 36 is provided on the underside of forefoot portion 12, and includes a plurality of equally spaced apart protuberances 38 therein. Recess 36 occupies a substantial central area of toe portion 12. Preferably, protuberances 38 also have a cylindrical configuration of approximately 0.30 inch diameter and a height of about 0.03 inch, although the present invention is not limited thereby. For example, protuberances 38 can have other dimensions and other configurations such as square, triangular or polygonal cross-sectional columnar shapes, or other shapes, such as spaced apart sinusoidal walls or the like. The lower ends of protuberances 38 are substantially coplanar with the lower surface of insole 10.

The reason for providing protuberances 32 and 38 in recesses 34 and 36 of heel portion 14 and forefoot portion 12, respectively, is that these are the areas where the major forces are exerted on insole 10 during heel impact and during push off. With this arrangement, protuberances 32 and 38 provide a quicker acting spring than the remainder of insole 10, but with less dampening energy absorption. Thus, when a force is applied to protuberances 32 and 38, the response is more like a spring than as a damper, while the remainder of lower cushioning layer 18 has an opposite response, that is, acting more like a damper than a spring. This combination gives insole 10 a unique feature of a fast reaction on first heel impact and a slower higher damped energy absorption as the heel recedes into insole 10. When the heel recedes from insole 10, the reverse action occurs, that is, protuberances 32 return some of the spring action to the heel. When the foot moves to push off, the action of insole 10 is the same. In other words, this combination gives insole 10 a unique feature of a fast reaction on first forefoot impact and a slower higher damped energy absorption as the forefoot recedes into the viscous base of insole 10. When the forefoot recedes from insole 10, the reverse action occurs, that is, protuberances 38 return some of the spring action to the forefoot, giving the foot a softer impact and a springy push off.

The reason for the different dimensions of protuberances 32 and 38 is due to the fact that the person applies the same force on forefoot portion 12 as on heel portion 14, but stays over forefoot portion 12 for a longer period of time.

Protuberances 32 and 38 also function to absorb shear from any sidewards movement of the foot on insole 10.

Although the present invention uses the term insole, it will be appreciated that the use of other equivalent or similar terms such as innersole or insert are considered to be synonymous and interchangeable, and thereby covered by the present claimed invention.

Further, although the present invention has been discussed in relation to a removable insole, it can be incorporated as a permanent inner sole in footwear, such as a shoe or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

Parts Designator

10 insole
12 forefoot portion
14 heel portion
14*a* flat central portion
14*b* sloped side wall
16 mid-foot portion
16*a* raised medial arch portion
16*b* side wall
18 lower cushioning layer
20 top cover
22 medial side
23 lateral side
24*a–d* pattern trim lines
26 thin shell
26*a* flange
26*b* flange
28 oval opening
30 gap
32 protuberances
34 oval recess
36 recess
38 protuberances

What is claimed is:

1. A removable insole for insertion into footwear, comprising:

a forefoot portion extending at least to metatarsals of a foot;

a cupped heel portion including a relatively flat central portion and a sloped side wall surrounding said relatively flat central portion;

a mid-foot portion connecting together said forefoot portion and said heel portion, said mid-foot portion including a medial arch portion defined by an extension of said sloped side wall, and said forefoot portion, heel portion and mid-foot portion formed from a unitary resilient material; and a shell that extends along an underside of said insole, said shell extending under said medial arch portion and said side wall, said shell having an opening beneath said relatively flat central portion of said cupped heel portion and a gap at a rearmost end of said shell so as to define flanges on opposite sides of said insole at said heel portion, and said shell being made of a resilient material that is stiffer than said unitary resilient material, wherein said unitary resilient material extends out through said opening in said shell, and includes a recess at an undersurface thereat with a plurality of first protuberances in said recess, said first protuberances forming spaced apart spring walls and said first protuberances having lower edges generally coplanar with a lower surface of said heel portion.

2. A removable insole according to claim 1, wherein said first protuberances have a generally cylindrical configuration.

3. A removable insole according to claim 1, wherein said unitary resilient material includes a second recess at an undersurface thereof at said forefoot portion, with a plurality of second protuberances in said second recess, said second protuberances forming spaced apart spring walls and said second protuberances having lower edges generally coplanar with a lower surface of said heel portion.

4. A removable insole according to claim 3, wherein said second protuberances have a generally cylindrical configuration.

5. A removable insole according to claim 3, wherein said first and second protuberances have a height and width, and the height of said second protuberances is less than the height of said first protuberances, and the width of said second protuberances is greater than the width of said first protuberances.

6. A removable insole according to claim 1, further comprising a top cover secured to upper surfaces of said forefoot portion, mid-foot portion and heel portion.

7. A removable insole according to claim 1, further comprising at least one pattern trim line at the forefoot portion for trimming the insole to fit into smaller size footwear.

8. An insole according to claim 1, wherein said medial arch portion has a height greater than a remainder of said mid-foot portion, and extends approximately 40% of the distance from a medial side of said insole to a lateral side of said insole.

9. Footwear comprising:

an outer sole;

an inner sole connected to said outer sole, said inner sole including:

a forefoot portion extending at least to metatarsals of a foot, a cupped heel portion including a relatively flat central portion and a sloped side wall surrounding said relatively flat central portion, a mid-foot portion connecting together said forefoot portion and said heel portion, said mid-foot portion including a medial arch portion defined by an extension of said sloped side wall, and said forefoot portion, heel portion and mid-foot portion formed from a unitary resilient material, and a shell that extends along an underside of said insole, said shell extending under said medial arch portion and said side wall, said shell having an opening beneath said relatively flat central portion of said cupped heel portion and a gap at a rearmost end of said shell so as to define flanges on opposite sides of said insole at said heel portion, and said shell being made of a resilient material that is stiffer than said unitary resilient material; and an upper connected to at least one of said outer sole and said inner sole, wherein said unitary resilient material extends out through said opening in said shell, and includes a recess at an undersurface thereat with a plurality of first protuberances in said recess, said first protuberances forming spaced apart spring walls and said first protuberances having lower edges generally coplanar with a lower surface of said heel portion.

10. Footwear according to claim 9, wherein said first protuberances have a generally cylindrical configuration.

11. Footwear according to claim 9, wherein said unitary resilient material includes a second recess at an undersurface thereof at said forefoot portion, with a plurality of second protuberances in said second recess, said second protuberances forming spaced apart spring walls and said second protuberances having lower edges generally coplanar with a lower surface of said heel portion.

12. Footwear according to claim 11, wherein said second protuberances have a generally cylindrical configuration.

13. Footwear according to claim 11, wherein said first and second protuberances have a height and width, and the height of said second protuberances is less than the height of said first protuberances, and the width of said second protuberances is greater than the width of said first protuberances.

14. Footwear according to claim 9, further comprising a top cover secured to upper surfaces of said forefoot portion, mid-foot portion and heel portion.

15. An insole according to claim 9, wherein said medial arch portion has a height greater than a remainder of said mid-foot portion, and extends approximately 40% of the distance from a medial side of said insole to a lateral side of said insole.

* * * * *